US007573379B2

(12) United States Patent
Moormeier et al.

(10) Patent No.: US 7,573,379 B2
(45) Date of Patent: Aug. 11, 2009

(54) MOBILE, RETRACTILE, LATERAL DEPLOYING, VEHICLE DISABLEMENT DEVICE

(75) Inventors: Michael Patrick Moormeier, 3269 Washington Way, Longview, WA (US) 98632; Todd Cory O'Halloran, 15590 SE. Heidi La., Damascus, OR (US) 97089

(73) Assignees: Pursuit Management, Inc., Carson City, NV (US); Michael Patrick Moormeier, Longview, WA (US); Todd Cory O'Halloran, Damascus, OR (US)

( * ) Notice: Subject to any disclaimer, the term of this patent is extended or adjusted under 35 U.S.C. 154(b) by 335 days.

(21) Appl. No.: 11/606,618

(22) Filed: Nov. 29, 2006

(65) Prior Publication Data

US 2008/0124171 A1 May 29, 2008

(51) Int. Cl.
*G08B 23/00* (2006.01)
*E01F 13/00* (2006.01)
*E01F 15/00* (2006.01)

(52) U.S. Cl. ..... 340/500; 404/6

(58) Field of Classification Search ..... 340/500; 404/6, 9; 180/287

See application file for complete search history.

(56) References Cited

U.S. PATENT DOCUMENTS

| | | | | |
|---|---|---|---|---|
| 5,406,251 | A * | 4/1995 | Leis | 180/281 |
| 5,611,408 | A * | 3/1997 | Abukhader | 404/6 |
| 5,890,832 | A * | 4/1999 | Soleau | 404/6 |
| 6,758,628 | B1 * | 7/2004 | Curry, Jr. | 404/6 |
| 6,869,248 | B1 * | 3/2005 | Threlkeld | 404/6 |
| 7,108,446 | B2 * | 9/2006 | Clark | 404/9 |
| 7,275,889 | B1 * | 10/2007 | McGill | 404/6 |
| 2008/0159809 | A1 * | 7/2008 | Costa | 404/6 |

* cited by examiner

*Primary Examiner*—John A Tweel, Jr.
(74) *Attorney, Agent, or Firm*—Schwabe, Williamson & Wyatt, P.C.

(57) ABSTRACT

A device when activated, disables a fleeing vehicle from within the operator's vehicle. The device mounts directly to the operator's vehicle. This device is controlled by the operator from within the vehicle by way of a control panel. When deemed necessary, the system is armed using a switch mounted on said panel. This allows for deployment upon activation of said switch. Upon positioning of operator car, the switch is activated, extending spike strip laterally. This places the spike strip under the pursued vehicle, in front of one or more of the tires. The operator applies the brakes of said vehicle, causing the spike strip to travel under the pursued vehicle's tire, disabling the vehicle. Upon traveling under the tire, the operator removes pressure from switch, causing the unit to safely stow itself. The system can then be re-deployed at will.

92 Claims, 11 Drawing Sheets

MOBILE, RETRACTILE, LATERAL DEPLOYING, VEHICLE DISABLEMENT DEVICE

RELATED APPLICATIONS

The present application is a continuation-in-part application of U.S. provisional patent application, Ser. No. 113264, filed Dec. 1, 2005, for MOBILE, LATERAL DEPLOYING, TIRE DEFLATION DEVICE, by Michael P. Moormeier, Todd C. O'Halloran, included by reference herein and for which benefit of the priority date is hereby claimed.

FIELD OF THE INVENTION

The present invention relates to vehicle disablement and, more particularly, to a device that is mobile and retractile.

BACKGROUND OF THE INVENTION

In the year 2005, there were over 750 police pursuits in the city of Los Angeles alone. In the state of California, in that same year, there were over 7,000 police pursuits. No less than three deaths, in the city of Los Angeles alone, can be attributed to those who would run from the police, recklessly endangering the lives and property of American citizens. Unfortunately, law enforcement officials have very limited resources in dealing with this problem. Solutions given to agencies thus far are only effective given a very specific set of circumstances. In addition, presently, agencies across the United States have begun to tie the hands of Law Enforcement personnel by instituting "no pursuit" policies. Although "no pursuit" policies may be the safest alternative, this is only true due to the fact that a means by which to deal with the problem does not exist.

Every single United States citizen pays for the rise in police pursuit. Studies show that damage from crashes associated with police pursuit is rarely limited to less than five figures. When you consider the fact that the acting vehicle, the police vehicles, and often times bystander vehicles are damaged, it is not hard to understand why damage can run in excess of $100,000 per incident. This cost is passed on to citizens through higher insurance rates.

Tragedy often times follows high-speed pursuit. The fact is, that innocent people die every year. Mothers and fathers, children and elderly, all walks of life, all across America, people are dying because a tool does not exist that allows police to stop a high-speed pursuit before it begins. No solution presently exists that allows the police, from within the safety of their vehicle, to disable a fleeing vehicle, and stop a pursuit.

Devices presently in use include U.S. Pat. No. 5,820,293 in which a device is thrown, by hand, across the roadway into the path of an oncoming pursued vehicle in order to deflate the tires. U.S. Pat. No. 5,775,832 describes a device that is used in the same manner as the previously listed device but differs in that the device itself is wider upon deployment and has a different type of spike. Although presently not in use, U.S. Pat. No. 6,623,205 describes a mobile device which when deployed is said to disable vehicle tires. Similarly, U.S. Pat. No. 5,839,849 describes a device meant to be used from within a police vehicle at speed. Devices described on television programs and magazines have included electronic remote controlled vehicles, which are said to have the ability to shut down a vehicle's computer, thus disabling said vehicle when remote controlled vehicle is driven under vehicle pursued. Scientific magazines have suggested that electromagnetic pulse may be used in the future.

Groen, U.S. Pat. No. 5,820,293 describes a device in which the police must know where the fleeing suspect is going and get there ahead of them, get out of the car and deploy said device across the roadway by hand. Similarly, Kilgrew U.S. Pat. No. 5,775,832 describes a device which must be deployed by hand across the roadway. These devices unfortunately, put the police officer in harm's way as they make it necessary for the police to exit their vehicle and stand next to the road to deploy their device. Devices such as U.S. Pat. No. 6,623,205 fail to deal with the fact that pursuits take place on every type of roadway, and that any uneven surface would damage the device described to the point it would be rendered useless and therefore necessitate costly repairs. Lowrie, U.S. Pat. No. 6,527,475 describes a device that necessitates police pulling in front of the pursued vehicle to deploy the device. Police are unwilling to do this, given the possibility that the suspect may have a weapon. Being in front of a suspect with a weapon is too dangerous for the police to even consider this course of action. The tethering of the described device provides for rapid deceleration of said device and therefore must be timed perfectly in order to be effective. In addition, the best possible use of the aforementioned device is its use when the police car is not moving.

It is therefore an object of the invention to provide a completely mobile means for vehicle disablement.

It is another object of the invention to provide for safe deployment of a vehicle disablement device by allowing deployment from within the police or operator vehicle.

It is another object of the invention to provide a vehicle disablement device that automatically retracts.

It is another object of the invention to provide a means for multiple deployments.

It is another object of the invention to provide a device that does not decelerate upon deployment.

It is another object of the invention to provide an engineered weak point and flexible joint by which the spike strip is attached to the device so as to prevent damage.

It is another object of the invention to provide a means for quick spike strip replacement without the aid of tools.

It is another object of the invention to provide a device that can be used in the blind spot of the pursued vehicle increasing officer safety.

It is another object of the invention to provide a device which can be deployed during a traffic stop to prevent suspect vehicle from leaving the scene.

It is another object of the invention to provide a maintained switch enabling deployment of a device without operator maintaining pressure on deployment switch.

It is another object of the invention to provide an on-board tool for vehicle disablement.

It is another object of the invention to provide for left and right side deployment.

SUMMARY OF THE INVENTION

In accordance with the present invention, there is provided a device which upon activation, disables a fleeing vehicle from within the safety of the operator's vehicle. The device mounts directly to the operator's vehicle. This device is controlled by the operator from within the vehicle by way of a control panel mounted within reach of either the driver or passenger of said vehicle. When deemed necessary, the system is armed using a protected switch mounted on said panel. This sends power to the momentary deployment switch and allows for instant deployment upon activation of said momentary deployment switch. Upon positioning of operator car, the momentary deployment switch is activated, allowing air from the air reservoir to flow through the solenoid valve and air hose to pressurize the telescoping assembly and thereby extend the piston and inner tube outward to their limiting stops. This action extends the spike strip outside of the inner tube laterally at a downward angle determined by the angle which telescoping assembly is mounted to vehicle. This places the spike strip under the pursued vehicle, in front of one or more of the pursued vehicle's tires. At this point, the operator of the device needs merely to apply the brakes of said vehicle, thereby causing the spike strip to travel under the pursued vehicle's tire, puncturing said tire and disabling the vehicle. Once the spike strip has traveled under the tire of the pursued vehicle, the operator needs only to remove pressure from the momentary deployment switch, causing the solenoid valve to exhaust the pressure within the telescoping assembly, allowing the large and small constant force springs to automatically retract and safely stow itself within the outer tubing from whence it came. The system can then be redeployed at will.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
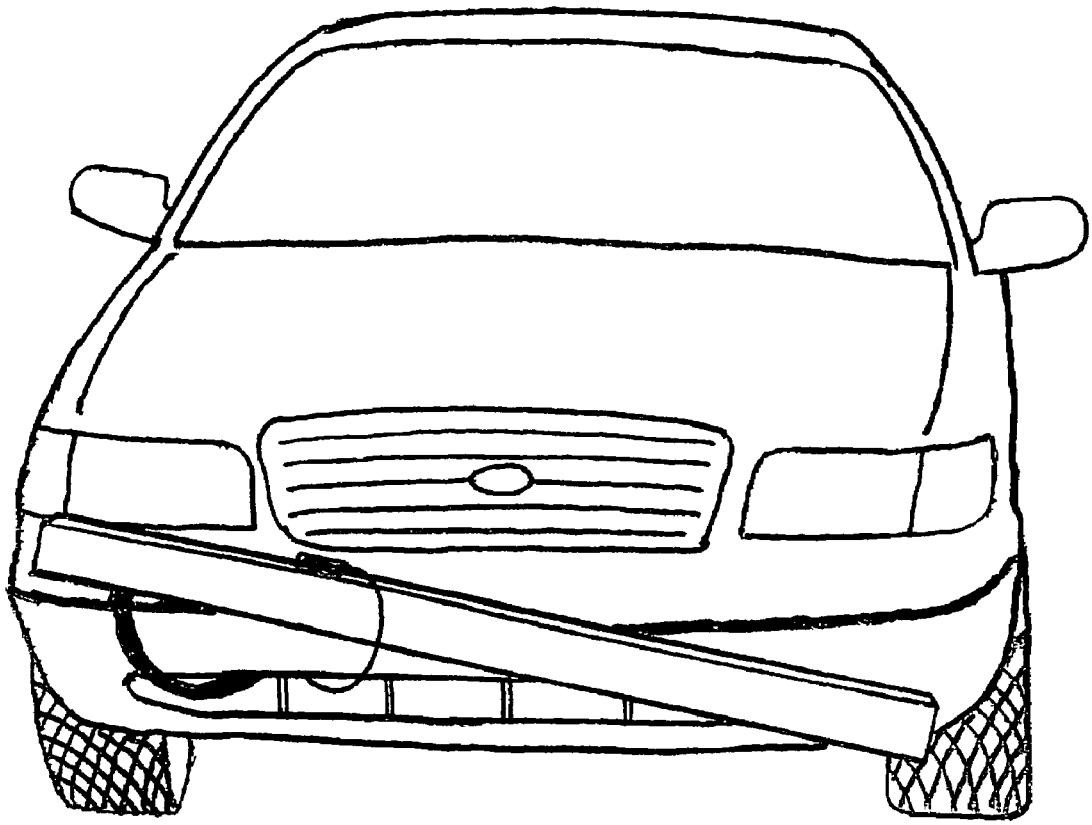
FIG. 1 is a front perspective view of a mobile, retractile, lateral deploying, vehicle disablement device, in retracted position, mounted to vehicle.

FIG. 1 is a front perspective view of a mobile, retractile, lateral deploying, vehicle disablement device, in retracted position, mounted to vehicle.

Figure 2:
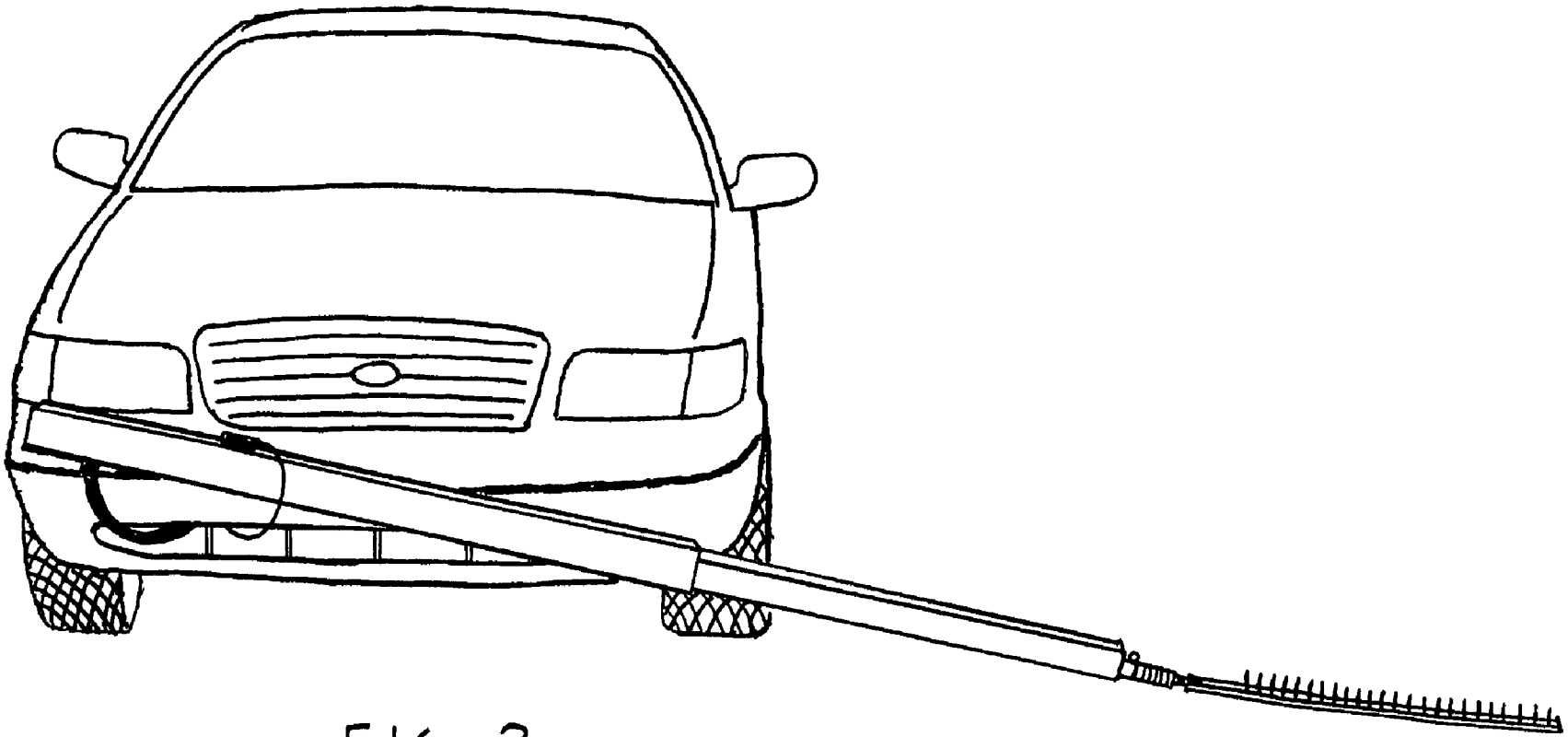
FIG. 2 is a front perspective view of a mobile, retractile, lateral deploying, vehicle disablement device, in deployed position, mounted to vehicle.

FIG. 2 is a front perspective view of a mobile, retractile, lateral deploying, vehicle disablement device, in deployed position, mounted to vehicle.

Figure 3:
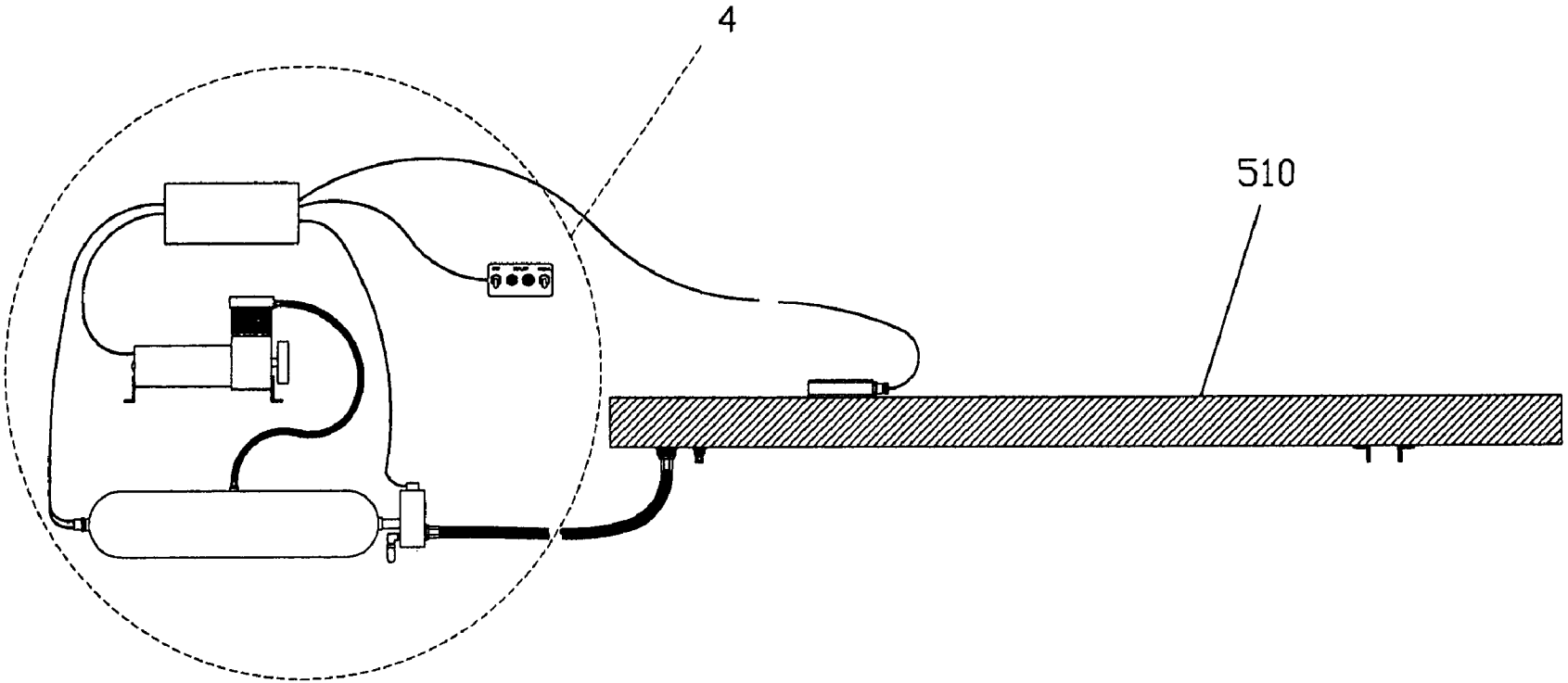
FIG. 3 is a front view of a mobile, retractile, lateral deploying, vehicle disablement device, with electrical and pneumatic systems attached.

FIG. 3 is a front view of a mobile, retractile, lateral deploying, vehicle disablement device, with electrical and pneumatic systems attached. Telescoping assembly 510 may be constructed of metal, plastic, or any suitable material forming a square, rectangle or any suitable shape when viewed from either end. Telescoping assembly 510 consists of all the elements listed except for the electrical and pneumatic systems. Telescoping assembly 510 is connected to the electrical and pneumatic systems using magnetic switch cable 232 and pneumatic air hose 224.

Figure 4:
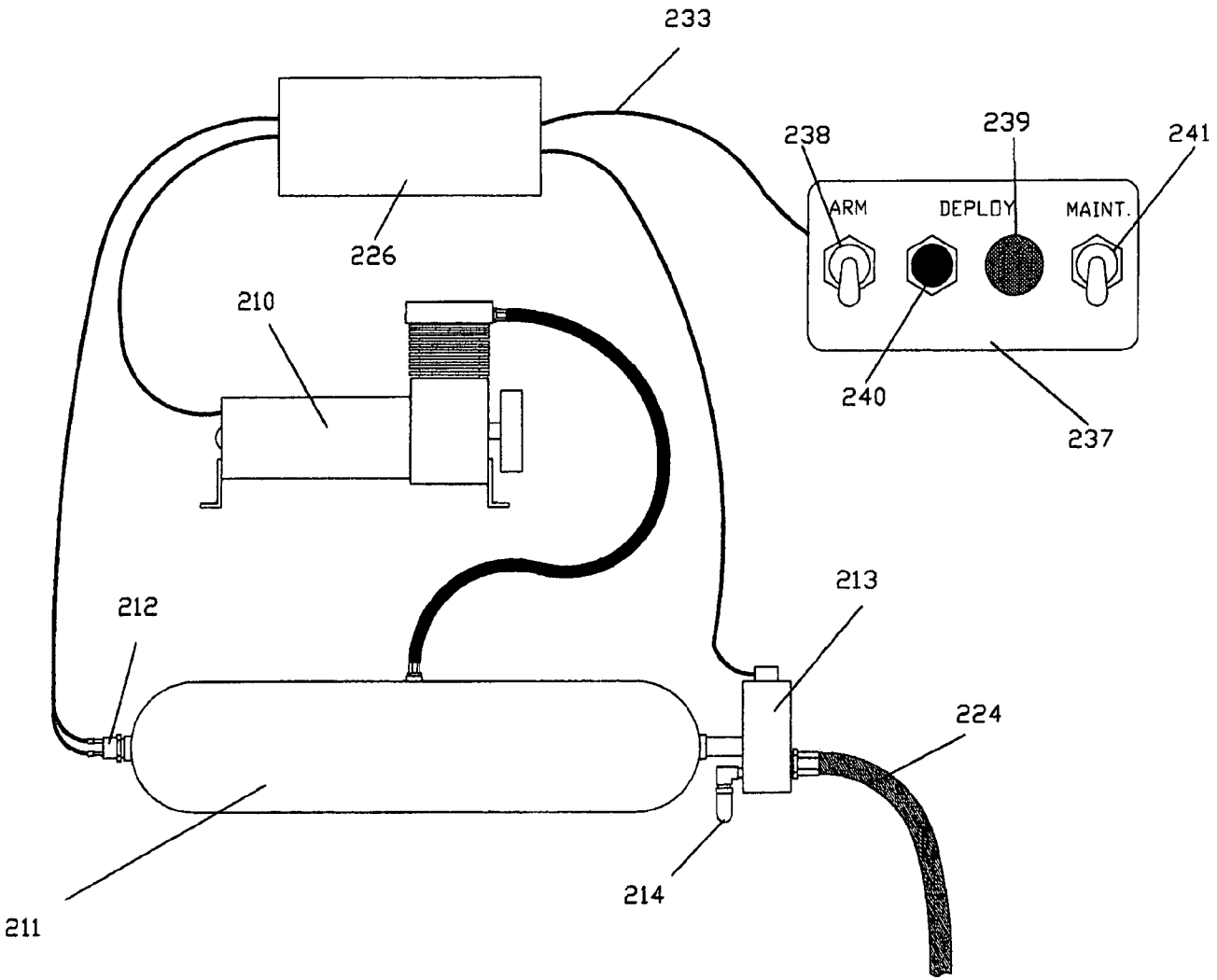
FIG. 4 is a front view of an electrical and pneumatic systems.

FIG. 4 is a front view of an electrical and pneumatic system.

Air hose 224 is a flexible, rubber-like hose or other suitable material. Air hose 224 is coupled to solenoid valve 213 by conventional means. Exhaust muffler 214 prevents debris and insects from entering the exhaust port of solenoid valve 213. Exhaust muffler 214 can be made of metal, plastic or other suitable material. Exhaust muffler 214 is connected to solenoid valve 213 by conventional means. Solenoid valve 213 is a three way type electrically operated pneumatic control valve or suitable replacement. Solenoid valve 213 is coupled to air reservoir 211 by conventional means. Solenoid valve 213 is electrically connected to electrical control enclosure 226 with electrical wiring. Air reservoir 211 is made of metal, fiberglass or other suitable material. Air reservoir 211 is connected to pneumatic compressor 210 using flexible, rigid or any suitable means of compressed air transfer. Pressure switch 212 is an air pressure operated switch that has a set of electrical contacts for controlling the pneumatic compressor 210. Pressure switch 212 is coupled to air reservoir 211 by conventional means. Pressure switch 212 is electrically connected to the electrical control enclosure 226 using standard electrical wiring. Pneumatic compressor 210 is an electric motor driven compressor or other suitable style. Pneumatic compressor 210 is electrically connected to electrical control enclosure 226 using standard electrical wiring. Electrical control enclosure 226 houses all wiring connections between the electrical components. Electrical control enclosure 226 is electrically connected to dash controls enclosure 237 using panel cable 233. Switch 238 is electrically connected to panel cable 233 and mounted to dash controls enclosure 237 using conventional means. Arming switch 238 is of the safety type with a safety snap cover to prevent unwanted operation of the switch. Arming switch 238 is electrically connected to dash cable and mounted to dash controls enclosure 237. Momentary deployment pushbutton 240 is electrically connected to dash cable and mounted to dash controls enclosure 237 using conventional means. Deployed indicator light 239 is electrically connected to dash cable and is mounted to dash controls enclosure 237 using conventional means. Maintained deployment switch 241 is electrically connected to dash cable and is mounted to dash controls enclosure 237 using conventional means. Dash controls enclosure 237 provides a housing for the dash area control switches used by the operator and is made of metal, plastic or other suitable material. Dash controls enclosure 237 is mounted to the dash area or any other appropriate area within reach of operator using conventional means.

Figure 5:
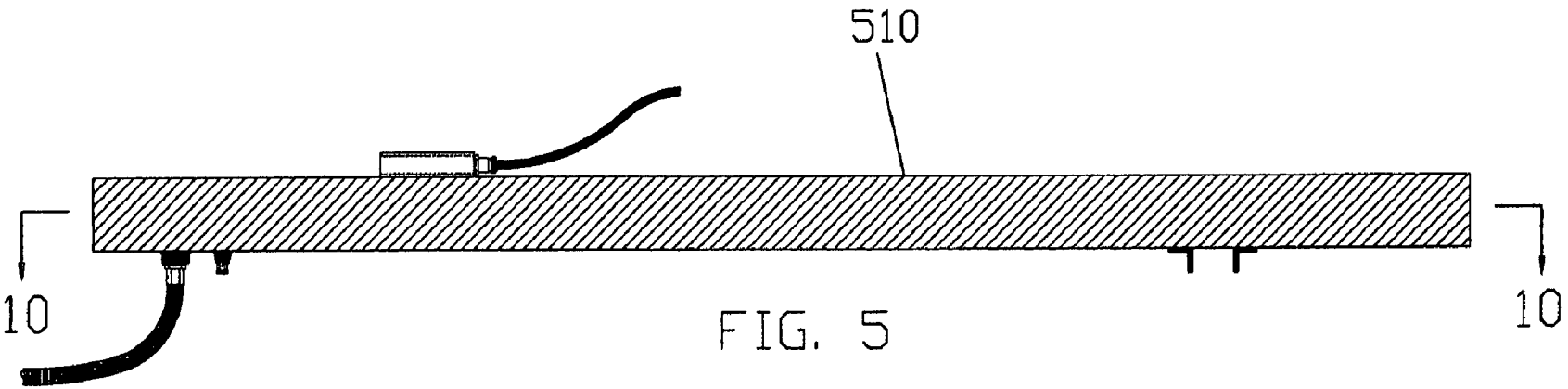
FIG. 5 is a front view of a mobile, retractile, lateral deploying, vehicle disablement device in the retracted position.

FIG. 5 is a front view of a mobile, retractile, lateral deploying, vehicle disablement device in the retracted position.

Figure 10:
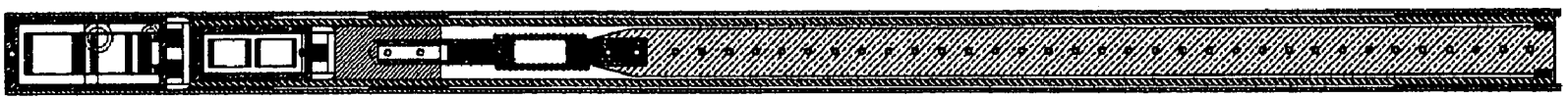
FIG. 10 is a top view of a mobile, retractile, lateral deploying, vehicle disablement device in retracted postion.

This figure also shows the reference to the section view of FIG. 10.

Figure 6:
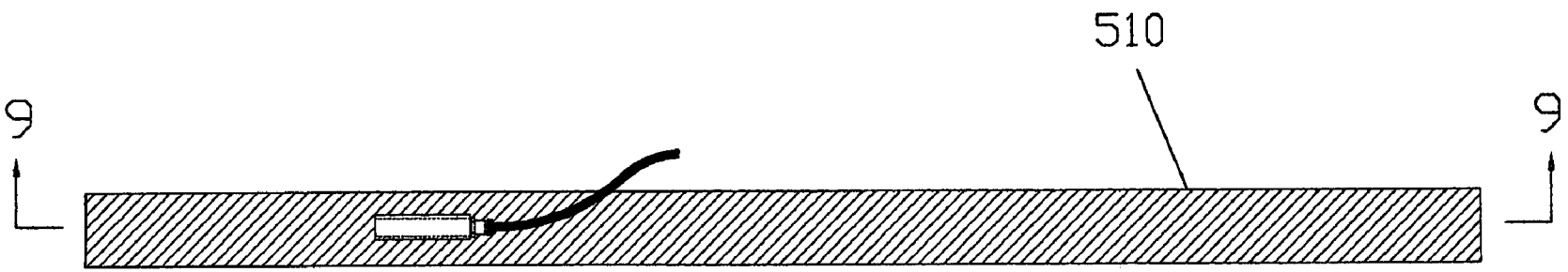
FIG. 6 is a top view of a mobile, retractile, lateral deploying, vehicle disablement device in retracted position.

FIG. 6 is a top view of a mobile, retractile, lateral deploying, vehicle disablement device in deployed position.

Figure 9:
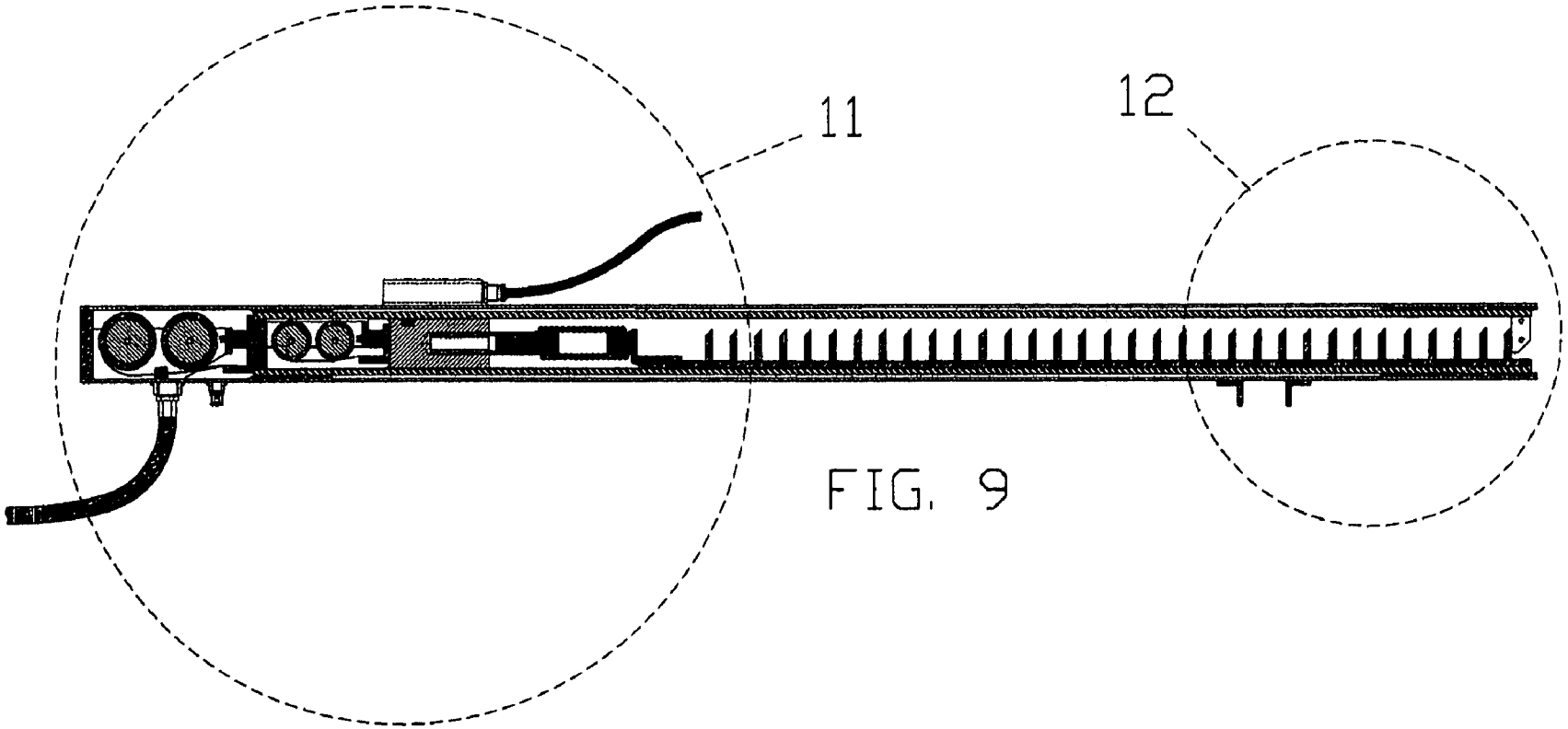
FIG. 9 is a front view of a mobile, retractile, lateral deploying, vehicle disablement device in retracted position.

This figure also shows the reference to the section view of FIG. 9.

Figure 7:
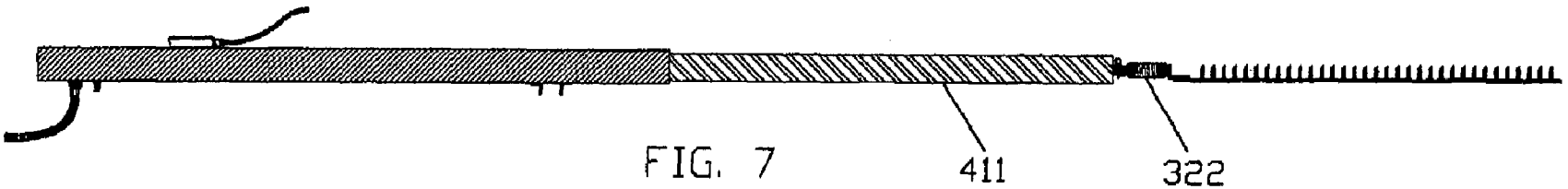
FIG. 7 is a front view of a mobile, retractile, lateral deploying, vehicle disablement device in deployed position.

FIG. 7 is a front view of a mobile, retractile, lateral deploying, vehicle disablement device in retracted position.

Inner tube 411 is shown in extended position. Pivot spring assembly 322 is fabricated from spring material and metal or other suitable materials. Pivot spring assembly 322 is shown in extended position to denote its placement in reference to the outermost end of the inner tube 411.

Figure 8:
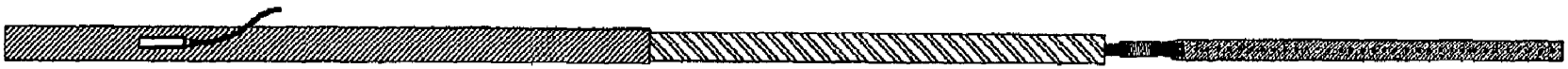
FIG. 8 is a top view of a mobile, retractile, lateral deploying, vehicle disablement device in deployed position.

FIG. 8 is a top view of a mobile, retractile, lateral deploying, vehicle disablement device in deployed position.

FIG. 9 is a front view of a mobile, retractile, lateral deploying, vehicle disablement device in retracted position.

Figure 11:
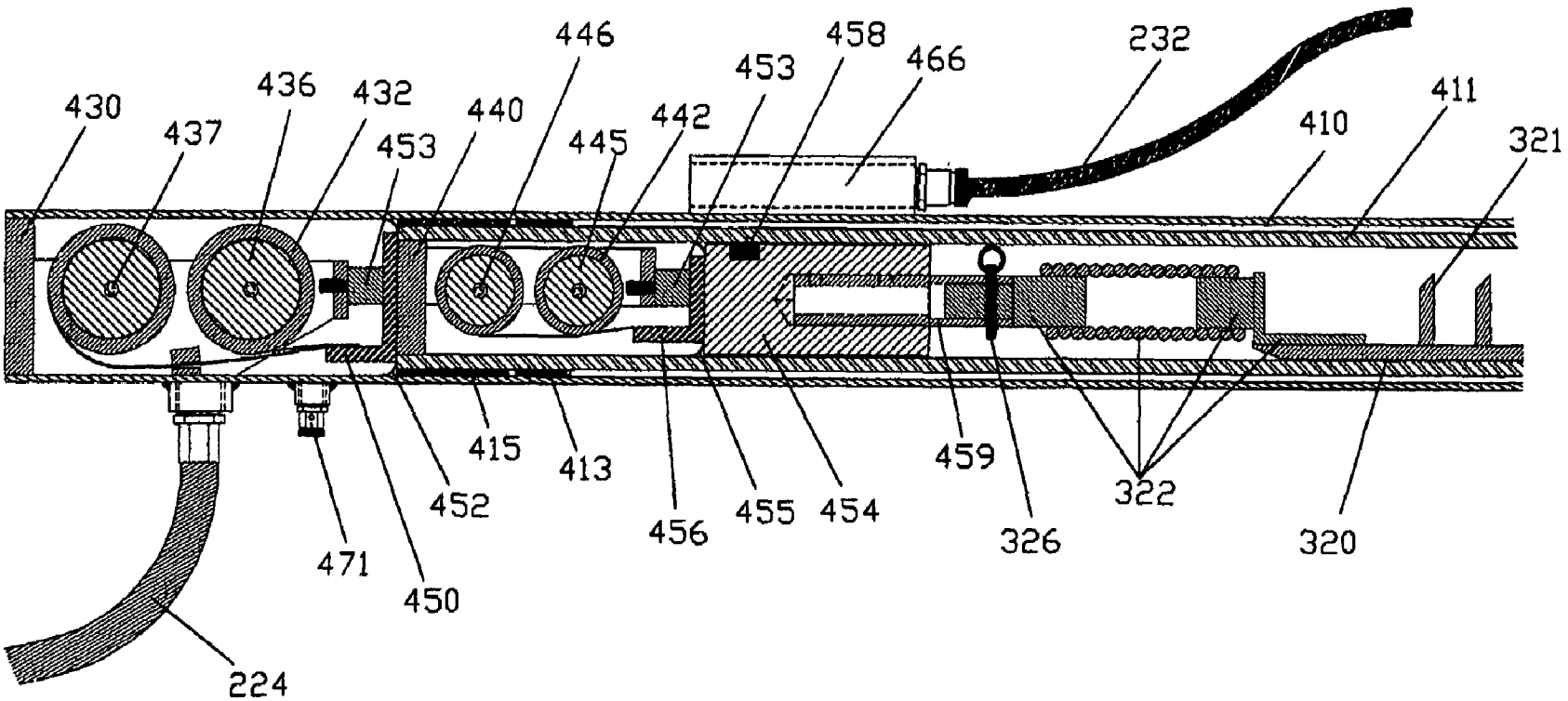
FIG. 11 is a front sectional detail view of a mobile, retractile, lateral deploying, vehicle disablement device in retracted position.
Figure 12:
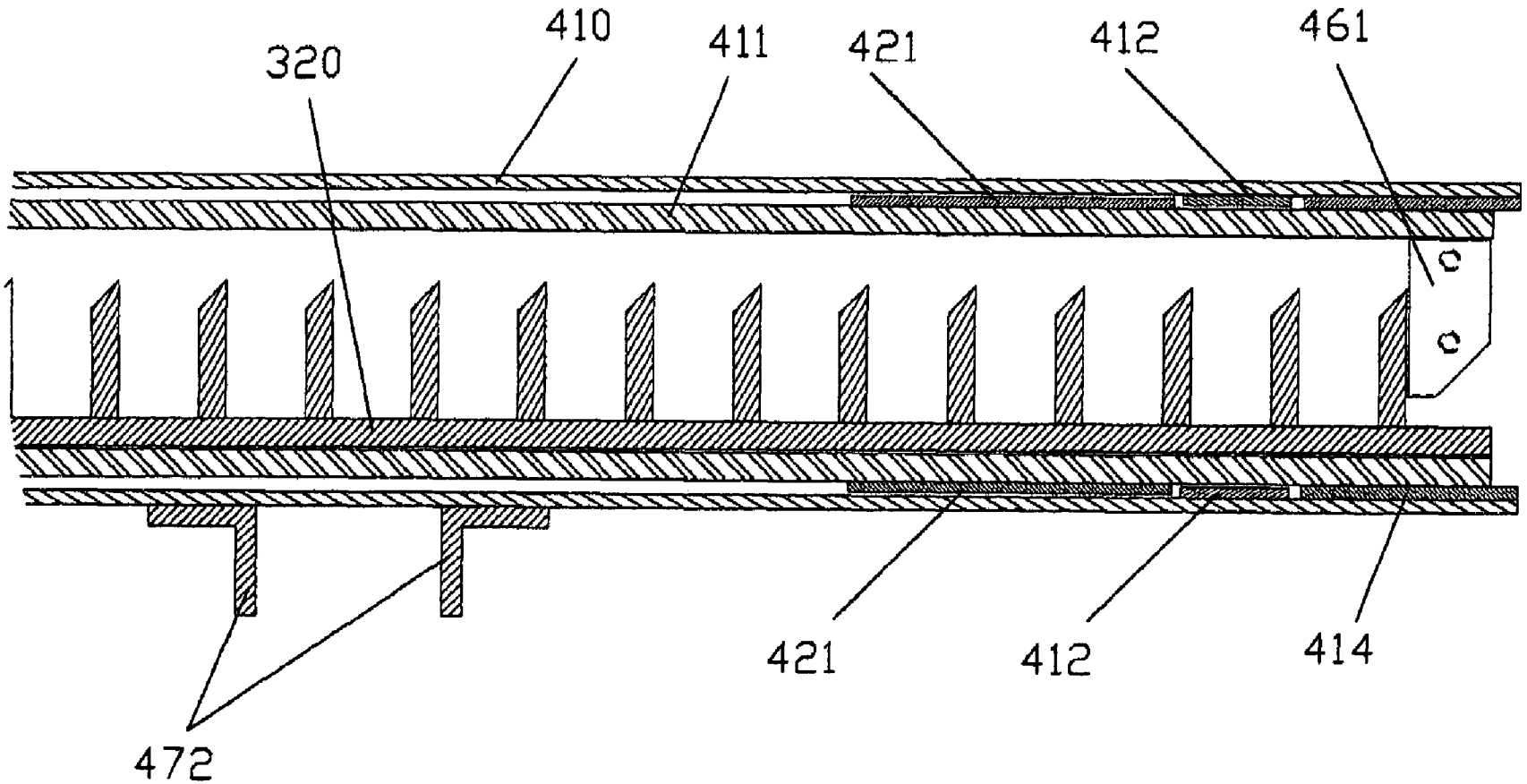
FIG. 12 is a front sectional detail view of a mobile, retractile, lateral deploying, vehicle disablement device in retracted position.

This figure also shows the reference to detailed views of FIG. 11 and FIG. 12.

FIG. 10 is a top view of a mobile, retractile, lateral deploying, vehicle disablement device in retracted position.

FIG. 11 is an enlarged front sectional view of a mobile, retractile, lateral deploying, vehicle disablement device in retracted position.

Outer tube 410 is fabricated from metal, plastic or other suitable material and is square, rectangle or other suitable shaped tubing. Inner tube 411 is fabricated from metal, plastic, or other suitable material and is the same shape as outer tube 410. Inner tube 411 is smaller in size than outer tube 410 allowing it to be inserted inside outer tube 410. Air hose 224 is connected to threaded hole on bottom of outer tube 410 by conventional means allowing for movement of compressed air from solenoid valve 213 to telescoping assembly 510. Air hose 224 is attached to threaded hole on bottom of outer tube 410 using a quick release coupling for convenience but is not required or limited to this means of connection. Pop off valve 471 is a pressure relieving device that prevents excessive pressure within telescoping assembly 510 and is attached to threaded hole on bottom of outer tube 410 by conventional means. Outer tube spring housing 430 is fabricated from metal, plastic or other suitable material. Outer tube spring housing 430 is inserted into outer tube 410 and is sealed and fastened using conventional means. Large spring drum axles 437 are female threaded metal or other suitable material. Large spring drum axles 437 are mounted within outer tube spring housing 430 using conventional fasteners. Large spring drums 436 are fabricated from plastic or other suitable material and provide a wheel-like action for the large constant force springs 432 to coil and uncoil upon. Large spring drums 436 are mounted and rotate upon large spring drum axles 437. Large constant force springs 432 are coiled around the circumference of large spring drums 436 and attached to large constant force springs end mount 450 using conventional means. Large constant force springs end mount 450 is fabricated from metal, plastic or other suitable material. Outer tube spring housing bumpers 453 are made of a rubber-like material and fastened with a threaded stud or other suitable means. Outer tube spring housing bumpers 453 are attached to outer tube spring housing 430 using conventional means. Large constant force springs end mount 450 is fabricated using metal, plastic or other suitable materials. Large constant force springs end mount 450 is fastened to inner tube spring housing 440 using conventional means. Inner tube seal 452 is made of rubber-like, plastic or other suitable material and fits the shape of the inside walls of the outer tube 410. Inner tube seal 452 is sandwiched between large constant force springs end mount 450 and inner tube spring housing 440 and is held in place by the compression force of the fasteners which attach large constant force springs end mount 450 to inner tube spring housing 440. Inner tube plastic bearing plates 415 are fabricated from sheet plastic or other suitable low friction material and are slightly thinner than the clearance between outer tube 410 and inner tube 411. Inner tube plastic bearing plates 415 are fastened to the outside surfaces at the innermost end of inner tube 411. Inner tube plastic bearing plates 415 provide a low friction surface for the innermost end of inner tube 411 to slide within outer tube 410. Inner tube stop plates 413 are fabricated from sheet metal or other suitable high strength material. Inner tube stop plates 413 are fastened to the outside surfaces of the inner tube 411 adjacent to inner tube plastic bearing plates 415. Inner tube spring housing 440 is fabricated from metal, plastic or other suitable material and houses the small constant force springs 442 with their associated small spring drums 445 and small spring drum axles 446. Inner tube spring housing 440 also provides a mount for inner tube spring housing bumper 451. Inner tube spring housing 440 is inserted into inner tube 411 and is sealed and fastened using conventional means. Small spring drum axles 446 are female threaded metal or other suitable material and are mounted within inner tube spring housing 440 using conventional fasteners. Small spring drums 445 are fabricated from plastic or other suitable material and provide a wheel-like action for the small constant force springs 442 to coil and uncoil upon. Small spring drums 445 are mounted and rotate upon small spring drum axles 446. Small constant force springs 442 are coiled around the circumference of small spring drums 445. Small constant force springs end mount 456 is fabricated from metal, plastic, or other suitable and fastened to inner most end of piston 454 using conventional means. Piston seal 455 is made of rubber-like, plastic or other suitable material and fits the shape of the inside walls of the inner tube 411 and is sandwiched between small constant force springs end mount 456 and piston 454. Piston seal 455 is held in place by the compression force of the fasteners which attach small constant force springs end mount 456 to piston 454. Magnet 458 is of the high force permanent type or other suitable style and is mounted within a recess of the piston 454 using friction, adhesives or other suitable means. This recess is deep enough to prevent the magnet 458 from rubbing inner tube 411. Magnetic switch 466 is of the reed type switch that is activated by the presence of a magnetic force in the immediate area. Magnetic switch 466 senses the magnet 458 that is mounted within piston 454. Magnetic switch 466 is mounted to the exterior of outer tube 410 using welds, adhesives or other suitable means of attachment. Magnetic switch 466 is electrically connected to electrical control enclosure 226 with magnetic switch cable 232. Piston 454 is fabricated from plastic or other suitable low friction material and provides a sturdy mount for pivot spring assembly female mounting tube 459. Piston 454 is inserted inside of inner tube 411 and travels between inner tube spring housing bumper 451 and piston end stops 461. Pivot spring assembly female mounting tube 459 is fabricated from metal pipe, metal bar stock or other suitable high strength material. Pivot spring assembly female mounting tube 459 is inserted inside of a drilled or machined hole in the outermost end of piston 454 and is fastened using conventional means. Pivot spring assembly female mounting tube 459 provides a sturdy female opening for pivot spring assembly 322 to be inserted within and held in place by pivot spring release pin 326. Pivot spring assembly 322 is fabricated from metal and an extension spring, or other suitable materials. The extension spring is welded or fastened to the other components forming the pivot spring assembly 322. This creates a flexible and sacrificial mount for the spike strip 320. Spike strip 320 is fabricated from metal, plastic or other suitable flexible materials and is attached to the outermost end of pivot spring assembly 322 using conventional means. Tire spikes 321 are fabricated from metal or other suitable high strength material. Tire spikes 321 are of the needle type, broadhead arrow type or other type suitable for being inserted into a tire and deflating it. Tire spikes 321 are inserted into holes in spike strip 320 and held in place by friction, adhesives or other suitable means. Tire spikes 321 are intended to penetrate the tire and be removed from spike strip 320 and stay lodged in tire.

FIG. 12 is an enlarged front sectional view of a mobile, retractile, lateral deploying, vehicle disablement device in retracted position.

Outer tube anti slide brackets 472 are fabricated from metal, plastic or other suitable material and are attached to outside bottom of outer tube 410 using conventional means. Outer tube anti slide brackets 472 prevent telescoping assembly 510 from sliding in vehicle mounting brackets. Stop plate bumpers 421 are fabricated from rubber-like sheets or other suitable material and are housed between the outer sides of inner tube 411 and inner sides of outer tube 410. Stop plate bumpers 421 are thinner than the space between inner tube 411 and outer tube 410 allowing stop plate bumpers 421 to float freely between inner tube stop plates 413 and outer tube stop plates 412. Stop plate bumpers 421 provide a cushion between inner tube stop plates 413 and outer tube stop plates 412 when inner tube 411 reaches outer most end of extension. Outer tube stop plates 412 are fabricated from sheet metal or other suitable high strength material and are fastened to inside surfaces of outer tube 410 adjacent to outer tube plastic bearing plates 414 using conventional means. Outer tube plastic bearing plates 414 are fabricated from plastic sheet or other suitable low friction material and are fastened to inside surfaces of outer most end of outer tube 410. Outer tube plastic bearing plates 414 are slightly thinner than clearance between outer tube 410 and inner tube 411. Outer tube plastic bearing plates 414 provide a low friction surface for inner tube 411 to slide within outer tube 410. Piston end stops 461 are fabricated from metal or other suitable high strength material and are fastened to two opposite inside surfaces at outer most end of inner tube 411 by conventional means. Piston end stops 461 also serve the function of limiting the travel of spike strip 320 upward within inner tube 411.

Figure 13:
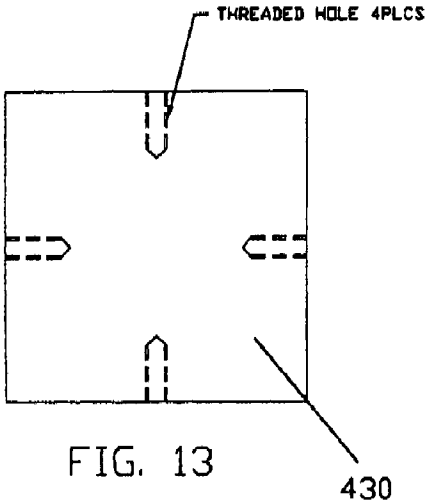
FIG. 13 is a left detail view of an outer tube spring housing 430.

FIG. 13 is a left detail view of the outer tube spring housing 430.

Figure 14:
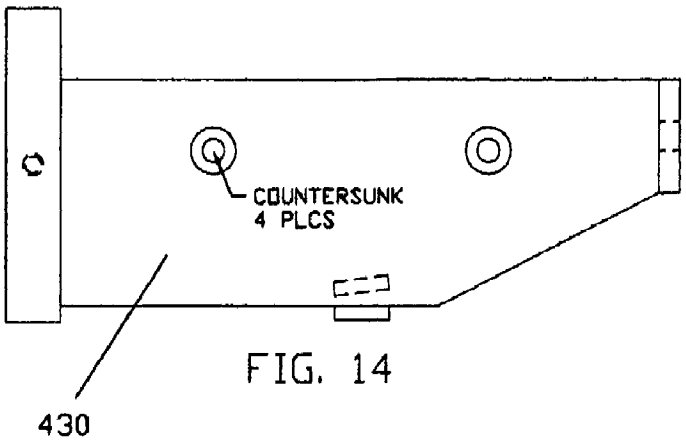
FIG. 14 is a front detail view of an outer tube spring housing 430.

FIG. 14 is a front detail view of the outer tube spring housing 430.

Figure 15:
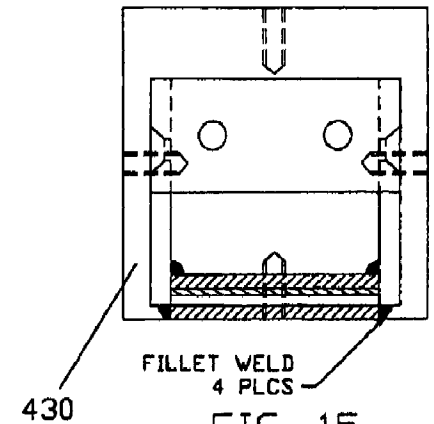
FIG. 15 is a right detail view of an outer tube spring housing 430.

FIG. 15 is a right detail view of the outer tube spring housing 430.

Outer tube spring housing 430 is fabricated from metal, plastic or other suitable material and is shown as a welded metal assembly. However the outer tube spring housing 430 can be glued or machined if suitable.

Figure 16:
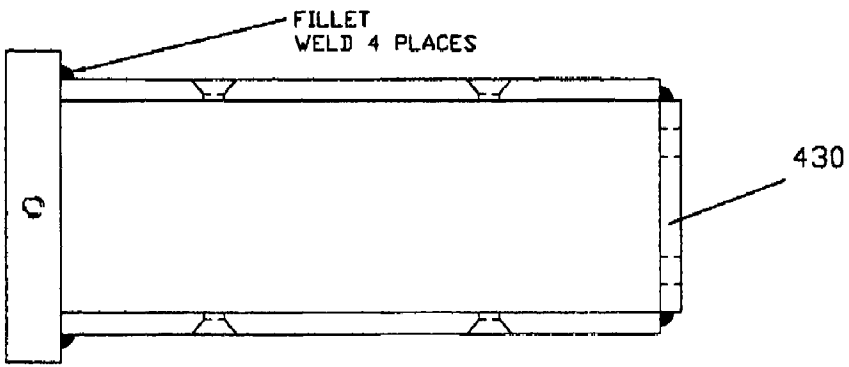
FIG. 16 is a top detail view of an outer tube spring housing 430.

FIG. 16 is a top detail view of the outer tube spring housing 430.

Outer tube spring housing 430 is fabricated from metal, plastic or other suitable material and is shown as a welded metal assembly. However the outer tube spring housing 430 can be glued or machined if suitable.

Figure 17:
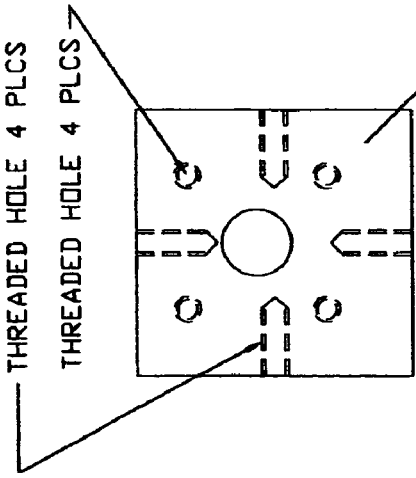
FIG. 17 is a left detail view of an inner tube spring housing 440.

FIG. 17 is a left detail view of the inner tube spring housing 440.

Figure 18:
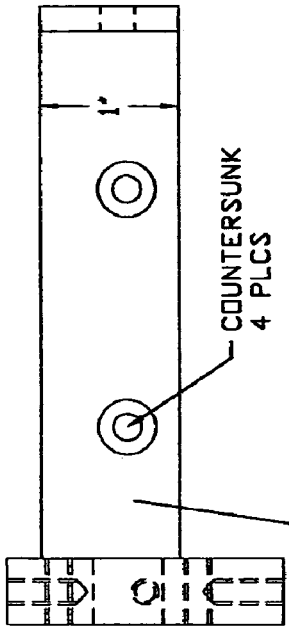
FIG. 18 is a front detail view of an inner tube spring housing 440.

FIG. 18 is a front detail view of the inner tube spring housing 440.

Figure 19:
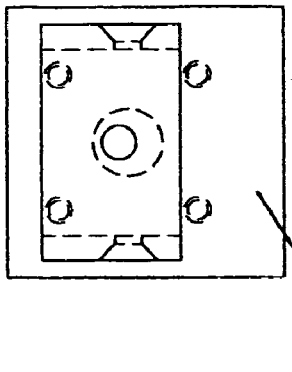
FIG. 19 is a right detail view of an inner tube spring housing 440.

FIG. 19 is a right detail view of the inner tube spring housing 440.

Figure 20:
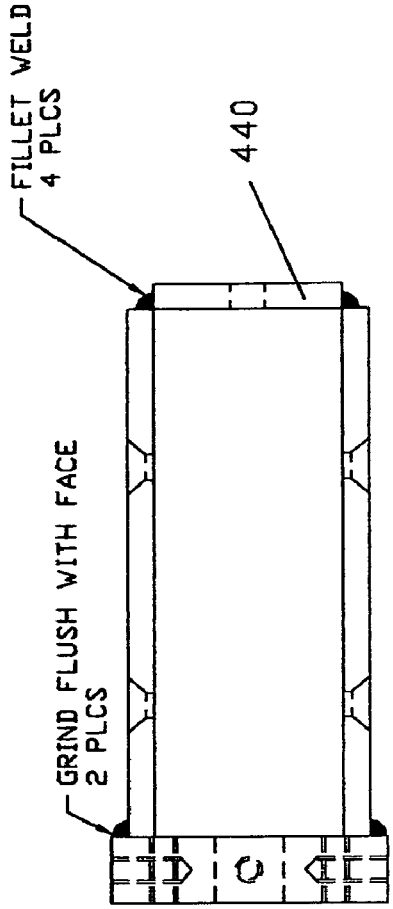
FIG. 20 is a top detail view of an inner tube spring housing 440.

FIG. 20 is a top detail view of the inner tube spring housing 440.

Inner tube spring housing 440 is fabricated from metal, plastic or other suitable material and is shown as a welded metal assembly. However the inner tube spring housing 440 can be glued or machined if suitable.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A mobile, retractile, lateral deploying, vehicle disablement device, for facilitating safe and quick vehicle disablement, comprising:

means for supplying compressed air for the operation of the mobile, retractile, lateral deploying vehicle disablement device;

means for maintaining a sufficient charge of compressed air to deploy telescopic assembly rapidly, flexibly coupled to said means for supplying compressed air for the operation of the mobile, retractile, lateral deploying vehicle disablement device;

means for regulating reservoir pressure by turning compressor on and off, threadably coupled to said means for maintaining a sufficient charge of compressed air to deploy telescopic assembly rapidly;

means for releasing the compressed air in reservoir to force the telescoping assembly to deploy when a solenoid is dissengaged it allows the compressed air inside of the telescoping assembly to be vented to atmosphere, rigidly coupled to said means for maintaining a sufficient charge of compressed air to deploy telescopic assembly rapidly;

means for delivering compressed air from solenoid valve to telescoping assembly, threadably coupled to said means for releasing the compressed air in reservoir to force the telescoping assembly to deploy when solenoid is dissengaged it allows the compressed air inside of the telescoping assembly to be vented to atmosphere;

means for housing dash switches, pushbutton(s) and indicator light(s);

means for relaying control signals from the dash mounted switches, buttons and indicator lights and the dash control enclosure that they are mounted in to an electrical controls enclosure;

means for facilitating the operator to arm the electrical system that controls the mobile, retractile, lateral deploying, vehicle disablement device, electrically wired to said means for housing dash switches, pushbutton(s) and indicator light(s);

means for primary method by which the operator deploys the telescoping assembly, electrically wired to said means for housing dash switches, pushbutton(s) and indicator light(s);

means for holding tire spikes and facilitating placement for tire disablement;

means for puncturing and deflating tire, releasably inserted to said means for holding tire spikes and facilitating placement for tire disablement;

means for connecting a spike strip to pivot spring female mounting tube and provides engineered weak point and flexibility, securely fastened to said means for holding tire spikes and facilitating placement for tire disablement;

means for providing quick release mechanism, and attachment of pivot spring assembly to pivot spring female mounting tube, removably inserted to said means for connecting spike strip to pivot spring female mounting tube and provides engineered weak point and flexibility;

means for housing all moving parts within telescoping assembly, removably coupled to said means for delivering compressed air from solenoid valve to telescoping assembly;

means for telescoping within outer tube and housing all components located within;

means for providing for the outer limit of inner tube travel outward during extension, securely fastened to said means for housing all moving parts within telescoping assembly;

means for providing for the outer limit of inner tube travel during extension, securely fastened to said means for telescoping within outer tube and housing all components located within;

means for providing a low friction surface for inner tube to telescope within outer tube, securely fastened to said means for telescoping within outer tube and housing all components located within;

means for providing a low friction surface for the inner tube to telescope within the outer tube, securely fastened to said means for housing all moving parts within telescoping assembly;

means for providing a cushion between the outer tube stop plate and the inner tube stop plate, slidably housed to said means for housing all moving parts within telescoping assembly;

means for housing one or more large constant force springs, providing mounting surface for shock-absorbing bumper and sealing off one end of the outer tube, sealingly inserted to said means for housing all moving parts within telescoping assembly;

means for providing the retraction force upon the inner tube;

means for providing rotating mount onto which large constant force spring is coiled, circumferentially wrapped to said means for providing the retraction force upon the inner tube;

means for providing pivot for large spring drums to rotate upon, rotatably encircling to said means for providing rotating mount onto which large constant force spring is coiled, and axially fastened to said means for housing the large constant force springs, providing mounting surface for shock-absorbing bumper and sealing off one end of the outer tube;

means for housing small constant force springs, providing mounting surface for shock-absorbing bumper, and sealing one end of inner tube, sealingly inserted to said means for telescoping within outer tube and housing all components located within;

means for providing retraction force upon piston;

means for providing rotating mount onto which small constant force spring is coiled, circumferentially wrapped to said means for providing retraction force upon piston;

means for providing pivot for small spring drum to rotate upon, rotatably encircling to said means for providing rotating mount onto which small constant force spring is coiled, and axially fastened to said means for housing small constant force springs, providing mounting surface for shock-absorbing bumper, and sealing one end of inner tube;

means for applying large constant force springs retraction force to innermost end of inner tube and also attaching inner tube seal to inner tube spring housing, securely fastened to said means for housing small constant force springs, providing mounting surface for shock-absorbing bumper, and sealing one end of inner tube, and securely fastened to said means for providing the retraction force upon the inner tube;

means for providing an air-tight seal between inner tube and outer tube, sealingly retained to said means for housing small constant force springs, providing mounting surface for shock-absorbing bumper, and sealing one end of inner tube;

means for providing a cushion between outer tube constant force spring housing and large constant force springs end mount at innermost end of inner tube travel, securely fastened to said means for housing the large constant force springs, providing mounting surface for shock-absorbing bumper and sealing off one end of the outer tube;

means for providing cushion between inner tube spring housing and small constant force springs end mount at innermost end of piston travel, securely fastened to said means for housing small constant force springs, providing mounting surface for shock-absorbing bumper, and sealing one end of inner tube;

means for providing a mount for pivot spring female mounting tube;

means for providing air-tight seal between piston and inner tube, sealingly retained to said means for providing a mount for pivot spring female mounting tube;

means for applying small constant force springs retraction force to piston and for holding piston seal to piston, securely screwed to said means for providing a mount for pivot spring female mounting tube, and securely fastened to said means for providing retraction force upon piston;

means for operating magnetic switch when inner tube and piston are fully retracted, entirely inserted to said means for providing a mount for pivot spring female mounting tube;

means for providing female mount of pivot spring assembly (male) to piston, centrally inserted and fastened to said means for providing a mount for pivot spring female mounting tube, removably inserted to said means for providing quick release mechanism, and attachment of pivot spring assembly to pivot spring female mounting tube, and releasably coupled to said means for connecting spike strip to pivot spring female mounting tube and provides engineered weak point and flexibility;

means for providing a stop for piston at the outer end of travel in the extended position, securely fastened to said means for telescoping within outer tube and housing all components located within;

means for sensing when piston and inner tube are at the innermost ends of both their travels and relaying this to dash mounted indicator light, magnetically linked to said means for operating magnetic switch when inner tube and piston are fully retracted, and directly attached to said means for housing all moving parts within telescoping assembly;

means for preventing excessive pressure inside telescoping assembly, threadably coupled to said means for housing all moving parts within telescoping assembly;

means for preventing the telescoping assembly from sliding in its mounting brackets; and means for facilitating the placement of a dissabling device.

2. The mobile, retractile, lateral deploying, vehicle disablement device, in accordance with claim 1, wherein said means for supplying compressed air for the operation of the mobile, retractile, lateral deploying vehicle dissablement device comprises a pneumatic compressor.

3. The mobile, retractile, lateral deploying, vehicle disablement device, in accordance with claim 1, wherein said means for maintaining a sufficient charge of compressed air to deploy telescopic assembly rapidly comprises an air reservoir.

4. The mobile, retractile, lateral deploying, vehicle disablement device, in accordance with claim 1, wherein said means for regulating reservoir pressure by turning compressor on and off comprises a pressure switch.

5. The mobile, retractile, lateral deploying, vehicle disablement device, in accordance with claim 1, wherein said means for releasing the compressed air in reservoir to force the telescoping assembly to deploy when solenoid is dissengaged it allows the compressed air inside of the telescoping assembly to be vented to atmosphere comprises a 3 way valve solenoid valve.

6. The mobile, retractile, lateral deploying, vehicle disablement device, in accordance with claim 1, wherein said means for delivering compressed air from solenoid valve to telescoping assembly comprises an air hose.

7. The mobile, retractile, lateral deploying, vehicle disablement device, in accordance with claim 1, wherein said means for housing dash switches, pushbutton(s) and indicator light(s) comprises a dash controls enclosure.

8. The mobile, retractile, lateral deploying, vehicle disablement device, in accordance with claim 1, wherein said means for relaying control signals from the dash mounted switches, buttons and indicator lights and the dash control enclosure that they are mounted in to the electrical controls enclosure comprises a multi conductor electrical cable panel cable.

9. The mobile, retractile, lateral deploying, vehicle disablement device, in accordance with claim 1, wherein said means for facilitating the operator to arm the electrical system that controls the mobile, retractile, lateral deploying, vehicle dissablement device comprises a safety type with protective cover arming switch.

10. The mobile, retractile, lateral deploying, vehicle disablement device, in accordance with claim 1, wherein said means for primary method by which the operator deploys the telescoping assembly comprises a momentary deployment pushbutton.

11. The mobile, retractile, lateral deploying, vehicle disablement device, in accordance with claim 1, wherein said means for holding tire spikes and facilitating placement for tire disablement comprises a spike strip.

12. The mobile, retractile, lateral deploying, vehicle disablement device, in accordance with claim 1, wherein said means for puncturing and deflating tire comprises a tire spikes.

13. The mobile, retractile, lateral deploying, vehicle disablement device, in accordance with claim 1, wherein said means for connecting spike strip to pivot spring female mounting tube and provides engineered weak point and flexability comprises a flexible springlike material pivot spring assembly.

14. The mobile, retractile, lateral deploying, vehicle disablement device, in accordance with claim 1, wherein said means for providing quick release mechanism, and attachment of pivot spring assembly to pivot spring female mounting tube comprises a ball detent type or similar pivot spring release pin.

15. The mobile, retractile, lateral deploying, vehicle disablement device, in accordance with claim 1, wherein said means for housing all moving parts within telescoping assembly comprises a non cylindrical tubing outer tube.

16. The mobile, retractile, lateral deploying, vehicle disablement device, in accordance with claim 1, wherein said means for telescoping within outer tube and housing all components located within comprises a non cylindrical tubing inner tube.

17. The mobile, retractile, lateral deploying, vehicle disablement device, in accordance with claim 1, wherein said means for providing for the outer limit of inner tube travel outward during extension comprises a 010" less thick than outer tube plastic bearing plate outer tube stop plates.

18. The mobile, retractile, lateral deploying, vehicle disablement device, in accordance with claim 1, wherein said means for providing for the outer limit of inner tube travel during extension comprises a 010" less thick than inner tube stop plate inner tube stop plates.

19. The mobile, retractile, lateral deploying, vehicle disablement device, in accordance with claim 1, wherein said means for providing a low friction surface for inner tube to telescope within outer tube comprises a same thickness as outer tube plastic bearing plate inner tube plastic bearing plates.

20. The mobile, retractile, lateral deploying, vehicle disablement device, in accordance with claim 1, wherein said means for providing a low friction surface for the inner tube to telescope within the outer tube comprises a 010" less thick than clearance between outer tube and inner tube outer tube plastic bearing plates.

21. The mobile, retractile, lateral deploying, vehicle disablement device, in accordance with claim 1, wherein said means for providing a cushion between the outer tube stop plate and the inner tube stop plate comprises a 010" less thick than plastic bearing plate, made of rubber like material stop plate bumpers.

22. The mobile, retractile, lateral deploying, vehicle disablement device, in accordance with claim 1, wherein said means for housing the large constant force springs, providing mounting surface for shock-absorbing bumper and sealing off one end of the outer tube comprises an outer tube spring housing.

23. The mobile, retractile, lateral deploying, vehicle disablement device, in accordance with claim 1, wherein said means for providing the retraction force upon the inner tube comprises a coiled constant force spring large constant force springs.

24. The mobile, retractile, lateral deploying, vehicle disablement device, in accordance with claim 1, wherein said means for providing rotating mount onto which large constant force spring is coiled comprises a cylindrical plastic rod large spring drums.

25. The mobile, retractile, lateral deploying, vehicle disablement device, in accordance with claim 1, wherein said means for providing pivot for large spring drums to rotate upon comprises a large spring drum axles.

26. The mobile, retractile, lateral deploying, vehicle disablement device, in accordance with claim 1, wherein said means for housing small constant force springs, providing mounting surface for shock-absorbing bumper, and sealing one end of inner tube comprises an inner tube spring housing.

27. The mobile, retractile, lateral deploying, vehicle disablement device, in accordance with claim 1, wherein said means for providing retraction force upon piston comprises a coiled constant force spring small constant force springs.

28. The mobile, retractile, lateral deploying, vehicle disablement device, in accordance with claim 1, wherein said means for providing rotating mount onto which small constant force spring is coiled comprises a cylindrical plastic rod small spring drums.

29. The mobile, retractile, lateral deploying, vehicle disablement device, in accordance with claim 1, wherein said means for providing pivot for small spring drum to rotate upon comprises a small spring drum axles.

30. The mobile, retractile, lateral deploying, vehicle disablement device, in accordance with claim 1, wherein said means for applying large constant force springs retraction force to innermost end of inner tube and also attaching inner tube seal to inner tube spring housing comprises a large constant force springs end mount.

31. The mobile, retractile, lateral deploying, vehicle disablement device, in accordance with claim 1, wherein said means for providing an air-tight seal between inner tube and outer tube comprises a flexible plastic or rubber-like material inner tube seal.

32. The mobile, retractile, lateral deploying, vehicle disablement device, in accordance with claim 1, wherein said means for providing a cushion between outer tube constant force spring housing and large constant force springs end mount at innermost end of inner tube travel comprises a rubber-like cushioning bumper with attachment bolt on one end outer tube spring housing bumpers.

33. The mobile, retractile, lateral deploying, vehicle disablement device, in accordance with claim 1, wherein said means for providing cushion between inner tube spring housing and small constant force springs end mount at innermost end of piston travel comprises a rubber-like cushion with mounting bolt on one end inner tube spring housing bumper.

34. The mobile, retractile, lateral deploying, vehicle disablement device, in accordance with claim 1, wherein said means for providing a mount for pivot spring female mounting tube comprises a plastic material, 020" smaller than inner dimension of inner tube, same shape as inside of inner tube piston.

35. The mobile, retractile, lateral deploying, vehicle disablement device, in accordance with claim 1, wherein said means for providing air-tight seal between piston and inner tube comprises a plastic or rubber-like material piston seal.

36. The mobile, retractile, lateral deploying, vehicle disablement device, in accordance with claim 1, wherein said means for applying small constant force springs retraction force to piston and for holding piston seal to piston comprises a small constant force springs end mount.

37. The mobile, retractile, lateral deploying, vehicle disablement device, in accordance with claim 1, wherein said means for operating magnetic switch when inner tube and piston are fully retracted comprises a high-force type magnet.

38. The mobile, retractile, lateral deploying, vehicle disablement device, in accordance with claim 1, wherein said means for providing female mount of pivot spring assembly (male) to piston comprises a pivot spring assembly female mounting tube.

39. The mobile, retractile, lateral deploying, vehicle disablement device, in accordance with claim 1, wherein said means for providing a stop for piston at the outer end of travel in the extended position comprises a piston end stops.

40. The mobile, retractile, lateral deploying, vehicle disablement device, in accordance with claim 1, wherein said means for sensing when piston and inner tube are at the innermost ends of both their travels and relaying this to dash mounted indicator light comprises a reed-type switch magnetic switch.

41. The mobile, retractile, lateral deploying, vehicle disablement device, in accordance with claim 1, wherein said means for preventing excessive pressure inside telescoping assembly comprises a pop off valve.

42. The mobile, retractile, lateral deploying, vehicle disablement device, in accordance with claim 1, wherein said means for preventing the telescoping assembly from sliding in its mounting brackets comprises a same material as outer tube outer tube anti slide brackets.

43. The mobile, retractile, lateral deploying, vehicle disablement device, in accordance with claim 1, wherein said means for facilitating the placement of a dissabling device comprises a telescoping assembly.

44. A mobile, retractile, lateral deploying, vehicle disablement device, for facilitating safe and quick vehicle disablement, comprising:

a pneumatic compressor, for supplying compressed air for the operation of the mobile, retractile, lateral deploying vehicle dissablement device;

an air reservoir, for maintaining a sufficient charge of compressed air to deploy telescopic assembly rapidly, flexibly coupled to said pneumatic compressor;

a pressure switch, for regulating reservoir pressure by turning compressor on and off, threadably coupled to said air reservoir;

a 3 way valve solenoid valve, for releasing the compressed air in reservoir to force the telescoping assembly to deploy when solenoid is dissengaged it allows the compressed air inside of the telescoping assembly to be vented to atmosphere, rigidly coupled to said air reservoir;

an air hose, for delivering compressed air from solenoid valve to telescoping assembly, threadably coupled to said solenoid valve;

a dash controls enclosure, for housing dash switches, pushbutton(s) and indicator light(s);

a multi conductor electrical cable panel cable, for relaying control signals from the dash mounted switches, buttons and indicator lights and the dash control enclosure that they are mounted in to the electrical controls enclosure;

a safety type with protective cover arming switch, for facilitating the operator to arm the electrical system that controls the mobile, retractile, lateral deploying, vehicle dissablement device, electrically wired to said dash controls enclosure;

a momentary deployment pushbutton, for primary method by which the operator deploys the telescoping assembly, electrically wired to said dash controls enclosure;

a spike strip, for holding tire spikes and facilitating placement for tire disablement;

a tire spikes, for puncturing and deflating tire, releasably inserted to said spike strip;

a flexible springlike material pivot spring assembly, for connecting spike strip to pivot spring female mounting tube and provides engineered weak point and flexibility, securely fastened to said spike strip;

a ball detent type or similar pivot spring release pin, for providing quick release mechanism, and attachment of pivot spring assembly to pivot spring female mounting tube, removably inserted to said pivot spring assembly;

a non cylindrical tubing outer tube, for housing all moving parts within telescoping assembly, removably coupled to said air hose;

a non cylindrical tubing inner tube, for telescoping within outer tube and housing all components located within;

a 010" less thick than outer tube plastic bearing plate outer tube stop plates, for providing for the during extension, securely fastened to said outer tube;

a 010" less thick than inner tube stop plate inner tube stop plates, for providing for the outer limit of inner tube travel during extension, securely fastened to said inner tube;

a same thickness as outer tube plastic bearing plate inner tube plastic bearing plates, for providing a low friction surface for inner tube to telescope within outer tube, securely fastened to said inner tube;

a 010" less thick than clearance between outer tube and inner tube outer tube plastic bearing plates, for providing a low friction surface for the inner tube to telescope within the outer tube, securely fastened to said outer tube;

a 010" less thick than plastic bearing plate, made of rubber like material stop plate bumpers, for providing a cushion between the outer tube stop plate and the inner tube stop plate, slidably housed to said outer tube;

an outer tube spring housing, for housing the large constant force springs, providing mounting surface for shock-absorbing bumper and sealing off one end of the outer tube, sealingly inserted to said outer tube;

a coiled constant force spring large constant force springs, for providing the retraction force upon the inner tube;

a cylindrical plastic rod large spring drums, for providing rotating mount onto which large constant force spring is coiled, circumferentially wrapped to said large constant force springs;

a large spring drum axles, for providing pivot for large spring drums to rotate upon, rotatably encircling to said large spring drums, and axially fastened to said outer tube spring housing;

an inner tube spring housing, for housing small constant force springs, providing mounting surface for shock-absorbing bumper, and sealing one end of inner tube, sealingly inserted to said inner tube;

a coiled constant force spring small constant force springs, for providing retraction force upon piston;

a cylindrical plastic rod small spring drums, for providing rotating mount onto which small constant force spring is coiled, circumferentially wrapped to said small constant force springs;

a small spring drum axles, for providing pivot for small spring drum to rotate upon, rotatably encircling to said small spring drums, and axially fastened to said inner tube spring housing;

a large constant force springs end mount, for applying large constant force springs retraction force to innermost end of inner tube and also attaching inner tube seal to inner tube spring housing, securely fastened to said inner tube spring housing, and securely fastened to said large constant force springs;

a flexible plastic or rubber-like material inner tube seal, for providing an air-tight seal between inner tube and outer tube, sealingly retained to said inner tube spring housing;

a rubber-like cushioning bumper with attachment bolt on one end outer tube spring housing bumpers, for providing a cushion between outer tube constant force spring housing and large constant force springs end mount at innermost end of inner tube travel, securely fastened to said outer tube spring housing;

a rubber-like cushion with mounting bolt on one end inner tube spring housing bumper, for providing cushion between inner tube spring housing and small constant force springs end mount at innermost end of piston travel, securely fastened to said inner tube spring housing;

a plastic material, 020" smaller than inner dimension of inner tube, same shape as inside of inner tube piston, for providing a mount for pivot spring female mounting tube;

a plastic or rubber-like material piston seal, for providing air-tight seal between piston and inner tube, sealingly retained to said piston;

a small constant force springs end mount, for applying small constant force springs retraction force to piston and for holding piston seal to piston, securely screwed to said piston, and securely fastened to said small constant force springs;

a high-force type magnet, for operating magnetic switch when inner tube and piston are fully retracted, entirely inserted to said piston;

a pivot spring assembly female mounting tube, for providing female mount of pivot spring assembly (male) to piston, centrally inserted and fastened to said piston, removably inserted to said pivot spring release pin, and releasably coupled to said pivot spring assembly;

a piston end stops, for providing a stop for piston at the outer end of travel in the extended position, securely fastened to said inner tube;

a reed-type switch magnetic switch, for sensing when piston and inner tube are at the innermost ends of both their travels and relaying this to dash mounted indicator light, magnetically linked to said magnet, and directly attached to said outer tube;

a pop off valve, for preventing excessive pressure inside telescoping assembly, threadably coupled to said outer tube;

a same material as outer tube outer tube anti slide brackets, for preventing the telescoping assembly from sliding in its mounting brackets; and a telescoping assembly, for facilitating the placement of a dissabling device.

45. The mobile, retractile, lateral deploying, vehicle disablement device, as recited in claim 44, further comprising:

an exhaust muffler, for quieting the discharge of compressed air to atmosphere and preventing debris and insects from entering solenoid valve exhaust port, threadably coupled to said solenoid valve.

46. The mobile, retractile, lateral deploying, vehicle disablement device, as recited in claim 44, further comprising:

an electrical control enclosure, for houses electrical relays, fuses, and related devices, electrically wired to said pneumatic compressor, electrically wired to said pressure switch, electrically wired to said solenoid valve, electrically wired to said dash controls enclosure, and electrically wired to said magnetic switch.

47. The mobile, retractile, lateral deploying, vehicle disablement device, as recited in claim 44, further comprising:
a magnetic switch cable, for connects magnetic switch to electrical control enclosure.

48. The mobile, retractile, lateral deploying, vehicle disablement device, as recited in claim 44, further comprising:
a deployed indicator light, for indicating to the operator that the telescoping assembly is
deployed, electrically wired to said dash controls enclosure.

49. The mobile, retractile, lateral deploying, vehicle disablement device, as recited in claim 44, further comprising:
a maintained deployment switch, that allows operator to deploy telescoping device for maintanence purposes operator does not need to keep finger on switch, thus allowing the operator to maintain telescoping assembly in the deployed position, electrically wired to said dash controls enclosure.

50. The mobile, retractile, lateral deploying, vehicle disablement device, as recited in claim 45, further comprising:
an electrical control enclosure, for houses electrical relays, fuses, and related devices, electrically wired to said pneumatic compressor,
electrically wired to said pressure switch, electrically wired to said solenoid valve, electrically wired to said dash controls enclosure, and electrically wired to said magnetic switch.

51. The mobile, retractile, lateral deploying, vehicle disablement device, as recited in claim 45, further comprising:
a magnetic switch cable, that connects magnetic switch to electrical control enclosure.

52. The mobile, retractile, lateral deploying, vehicle disablement device, as recited in claim 45, further comprising:
a deployed indicator light, for indicating to the operator that the telescoping assembly is deployed, electrically wired to said dash controls enclosure.

53. The mobile, retractile, lateral deploying, vehicle disablement device, as recited in claim 45, further comprising:
a maintained deployment switch, for allows operator to deploy telescoping device for maintanence purposes operator does not need to keep finger on switch, thus allowing the operator to maintain telescoping assembly in the deployed position, electrically wired to said dash controls enclosure.

54. The mobile, retractile, lateral deploying, vehicle disablement device, as recited in claim 46, further comprising:
a magnetic switch cable, that connects magnetic switch to electrical control enclosure.

55. The mobile, retractile, lateral deploying, vehicle disablement device, as recited in claim 46, further comprising:
a deployed indicator light, for indicating to the operator that the telescoping assembly is deployed, electrically wired to said dash controls enclosure.

56. The mobile, retractile, lateral deploying, vehicle disablement device, as recited in claim 46, further comprising:
a maintained deployment switch, that allows operator to deploy telescoping device for maintanence purposes operator does not need to keep finger on switch, thus allowing the operator to maintain telescoping assembly in the deployed position, electrically wired to said dash controls enclosure.

57. The mobile, retractile, lateral deploying, vehicle disablement device, as recited in claim 47, further comprising:
a deployed indicator light, for indicating to the operator that the telescoping assembly is deployed, electrically wired to said dash controls enclosure.

58. The mobile, retractile, lateral deploying, vehicle disablement device, as recited in claim 47, further comprising:
a maintained deployment switch, that allows operator to deploy telescoping device for maintanence purposes operator does not need to keep finger on switch, thus allowing the operator to maintain telescoping assembly in the deployed position, electrically wired to said dash controls enclosure.

59. The mobile, retractile, lateral deploying, vehicle disablement device, as recited in claim 48, further comprising:
a maintained deployment switch, that allows
operator to deploy telescoping device for maintanence purposes operator does not need to keep finger on switch, thus allowing the operator to maintain telescoping assembly in the deployed position, electrically wired to said dash controls enclosure.

60. The mobile, retractile, lateral deploying, vehicle disablement device, as recited in claim 50, further comprising:
a magnetic switch cable, that connects magnetic switch to electrical control enclosure.

61. The mobile, retractile, lateral deploying, vehicle disablement device, as recited in claim 50, further comprising:
a deployed indicator light, for indicating to the operator that the telescoping assembly is deployed, electrically wired to said dash controls enclosure.

62. The mobile, retractile, lateral deploying, vehicle disablement device, as recited in claim 50, further comprising:
a maintained deployment switch, that allows operator to deploy telescoping device for maintanence purposes operator does not need to keep finger on switch, thus allowing the operator to maintain telescoping assembly in the deployed position, electrically wired to said dash controls enclosure.

63. The mobile, retractile, lateral deploying, vehicle disablement device, as recited in claim 51, further comprising:
a deployed indicator light, for indicating to the operator that the telescoping assembly is deployed, electrically wired to said dash controls enclosure.

64. The mobile, retractile, lateral deploying, vehicle disablement device, as recited in claim 51, further comprising:
a maintained deployment switch, that allows operator to deploy telescoping device for maintanence purposes operator does not need to keep finger on switch, thus allowing the operator to maintain telescoping assembly in the deployed position, electrically wired to said dash controls enclosure.

65. The mobile, retractile, lateral deploying, vehicle disablement device, as recited in claim 52, further comprising:
a maintained deployment switch, that allows operator to deploy telescoping device for maintanence purposes operator does not need to keep finger on switch, thus allowing the operator to maintain telescoping assembly in the deployed position, electrically wired to said dash controls enclosure.

66. The mobile, retractile, lateral deploying, vehicle disablement device, as recited in claim 54, further comprising:
a deployed indicator light, for indicating to the operator that the telescoping assembly is deployed, electrically wired to said dash controls enclosure.

67. The mobile, retractile, lateral deploying, vehicle disablement device, as recited in claim 54, further comprising:
a maintained deployment switch, that allows operator to deploy telescoping device for maintanence purposes operator does not need to keep finger on switch, thus allowing the operator to maintain telescoping assembly in the deployed position, electrically wired to said dash controls enclosure.

68. The mobile, retractile, lateral deploying, vehicle disablement device, as recited in claim 55, further comprising:

a maintained deployment switch, that allows operator to deploy telescoping device for maintanence purposes operator does not need to keep finger on switch, thus allowing the operator to maintain telescoping assembly in the deployed position, electrically wired to said dash controls enclosure.

69. The mobile, retractile, lateral deploying, vehicle disablement device, as recited in claim 57, further comprising:

a maintained deployment switch, that allows operator to deploy telescoping device for maintanence purposes operator does not need to keep finger on switch, thus allowing the operator to maintain telescoping assembly in the deployed position, electrically wired to said dash controls enclosure.

70. The mobile, retractile, lateral deploying, vehicle disablement device, as recited in claim 60, further comprising:

a deployed indicator light, for indicating to the operator that the telescoping assembly is deployed, electrically wired to said dash controls enclosure.

71. The mobile, retractile, lateral deploying, vehicle disablement device, as recited in claim 60, further comprising:

a maintained deployment switch, that allows operator to deploy telescoping device for maintanence purposes operator does not need to keep finger on switch, thus allowing the operator to maintain telescoping assembly in the deployed position, electrically wired to said dash controls enclosure.

72. The mobile, retractile, lateral deploying, vehicle disablement device, as recited in claim 61, further comprising:

a maintained deployment switch, that allows operator to deploy telescoping device for maintanence purposes operator does not need to keep finger on switch, thus allowing the operator to maintain telescoping assembly in the deployed position, electrically wired to said dash controls enclosure.

73. The mobile, retractile, lateral deploying, vehicle disablement device, as recited in claim 63, further comprising:

a maintained deployment switch, that allows operator to deploy telescoping device for maintanence purposes operator does not need to keep finger on switch, thus allowing the operator to maintain telescoping assembly in the deployed position, electrically wired to said dash controls enclosure.

74. The mobile, retractile, lateral deploying, vehicle disablement device, as recited in claim 66, further comprising:

a maintained deployment switch, that allows operator to deploy telescoping device for maintanence purposes operator does not need to keep finger on switch, thus allowing the operator to maintain telescoping assembly in the deployed position, electrically wired to said dash controls enclosure.

75. The mobile, retractile, lateral deploying, vehicle disablement device, as recited in claim 70, further comprising:

a maintained deployment switch, that allows operator to deploy telescoping device for maintanence purposes operator does not need to keep finger on switch, thus allowing the operator to maintain telescoping assembly in the deployed position, electrically wired to said dash controls enclosure.

76. The mobile, retractile, lateral deploying, vehicle disablement device, as recited in claim 49, wherein said maintained deployment switch is safety type with protective cover.

77. The mobile, retractile, lateral deploying, vehicle disablement device, as recited in claim 53, wherein said maintained deployment switch is safety type with protective cover.

78. The mobile, retractile, lateral deploying, vehicle disablement device, as recited in claim 56, wherein said maintained deployment switch is safety type with protective cover.

79. The mobile, retractile, lateral deploying, vehicle disablement device, as recited in claim 58, wherein said maintained deployment switch is safety type with protective cover.

80. The mobile, retractile, lateral deploying, vehicle disablement device, as recited in claim 59, wherein said maintained deployment switch is safety type with protective cover.

81. The mobile, retractile, lateral deploying, vehicle disablement device, as recited in claim 62, wherein said maintained deployment switch is safety type with protective cover.

82. The mobile, retractile, lateral deploying, vehicle disablement device, as recited in claim 64, wherein said maintained deployment switch is safety type with protective cover.

83. The mobile, retractile, lateral deploying, vehicle disablement device, as recited in claim 65, wherein said maintained deployment switch is safety type with protective cover.

84. The mobile, retractile, lateral deploying, vehicle disablement device, as recited in claim 67, wherein said maintained deployment switch is safety type with protective cover.

85. The mobile, retractile, lateral deploying, vehicle disablement device, as recited in claim 68, wherein said maintained deployment switch is safety type with protective cover.

86. The mobile, retractile, lateral deploying, vehicle disablement device, as recited in claim 69, wherein said maintained deployment switch is safety type with protective cover.

87. The mobile, retractile, lateral deploying, vehicle disablement device, as recited in claim 71, wherein said maintained deployment switch is safety type with protective cover.

88. The mobile, retractile, lateral deploying, vehicle disablement device, as recited in claim 72, wherein said maintained deployment switch is safety type with protective cover.

89. The mobile, retractile, lateral deploying, vehicle disablement device, as recited in claim 73, wherein said maintained deployment switch is safety type with protective cover.

90. The mobile, retractile, lateral deploying, vehicle disablement device, as recited in claim 74, wherein said maintained deployment switch is safety type with protective cover.

91. The mobile, retractile, lateral deploying, vehicle disablement device, as recited in claim 75, wherein said maintained deployment switch is safety type with protective cover.

92. A mobile, retractile, lateral deploying, vehicle disablement device, for facilitating safe and quick vehicle disablement, comprising:

a pneumatic compressor, for supplying compressed air for the operation of the mobile, retractile, lateral deploying vehicle dissablement device;

an air reservoir, for maintaining a sufficient charge of compressed air to deploy telescopic assembly rapidly, flexibly coupled to said pneumatic compressor;

a pressure switch, for regulating reservoir pressure by turning compressor on and off, threadably coupled to said air reservoir;

a 3 way valve solenoid valve, for releasing the compressed air in reservoir to force the telescoping assembly to deploy when solenoid is dissengaged it allows the compressed air inside of the telescoping assembly to be vented to atmosphere, rigidly coupled to said air reservoir;

an exhaust muffler, for quieting the discharge of compressed air to atmosphere and preventing debris and insects from entering solenoid valve exhaust port, threadably coupled to said solenoid valve;

an air hose, for delivering compressed air from solenoid valve to telescoping assembly, threadably coupled to said solenoid valve;

an electrical control enclosure, for houses electrical relays, fuses, and related devices, electrically wired to said solenoid valve, electrically wired to said pressure switch, and electrically wired to said pneumatic compressor;

a magnetic switch cable, that connects magnetic switch to electrical control enclosure;

a dash controls enclosure, for housing dash switches, pushbutton(s) and indicator light(s), electrically wired to said electrical control enclosure;

a multi conductor electrical cable panel cable, for relaying control signals from the dash mounted switches, buttons and indicator lights and the dash control enclosure that they are mounted in to the electrical controls enclosure;

a safety type with protective cover arming switch, for facilitating the operator to arm the electrical system that controls the mobile, retractile, lateral deploying, vehicle dissablement device, electrically wired to said dash controls enclosure;

a deployed indicator light, for indicating to the operator that the telescoping assembly is deployed, electrically wired to said dash controls enclosure;

a momentary deployment pushbutton, for primary method by which the operator deploys the telescoping assembly, electrically wired to said dash controls enclosure;

a safety type with protective cover maintained deployment switch, that allows operator to deploy telescoping device for maintanence purposes operator does not need to keep finger on switch, thus allowing the operator to maintain telescoping assembly in the deployed position, electrically wired to said dash controls enclosure;

a spike strip, for holding tire spikes and facilitating placement for tire disablement;

a tire spikes, for puncturing and deflating tire, releasably inserted to said spike strip;

a flexible springlike material pivot spring assembly, for connecting spike strip to pivot spring female mounting tube and provides engineered weak point and flexibility, securely fastened to said spike strip;

a ball detent type or similar pivot spring release pin, for providing quick release mechanism, and attachment of pivot spring assembly to pivot spring female mounting tube, removably inserted to said pivot spring assembly;

a non cylindrical tubing outer tube, for housing all moving parts within telescoping assembly, removably coupled to said air hose;

a non cylindrical tubing inner tube, for telescoping within outer tube and housing all components located within;

a 010" less thick than outer tube plastic bearing plate outer tube stop plates, for providing for the outer limit of inner tube travel outward during extension, securely fastened to said outer tube;

a 010" less thick than inner tube stop plate inner tube stop plates, for providing for the outer limit of inner tube travel during extension, securely fastened to said inner tube;

a same thickness as outer tube plastic bearing plate inner tube plastic bearing plates, for providing a low friction surface for the inner tube to telescope within outer tube, securely fastened to said inner tube;

a 010" less thick than clearance between outer tube and inner tube outer tube plastic bearing plates, for providing a low friction surface for the inner tube to telescope within the outer tube, securely fastened to said outer tube;

a 010" less thick than plastic bearing plate, made of rubber like material stop plate bumpers, for providing a cushion between the outer tube stop plate and the inner tube stop plate, slidably housed to said outer tube;

an outer tube spring housing, for housing the large constant force springs, providing mounting surface for shock-absorbing bumper and sealing off one end of the outer tube, sealingly inserted to said outer tube;

a coiled constant force spring large constant force springs, for providing the retraction force upon the inner tube;

a cylindrical plastic rod large spring drums, for providing rotating mount onto which large constant force spring is coiled, circumferentially wrapped to said large constant force springs;

a large spring drum axles, for providing pivot for large spring drums to rotate upon, rotatably encircling to said large spring drums, and axially fastened to said outer tube spring housing;

an inner tube spring housing, for housing small constant force springs, providing mounting surface for shock-absorbing bumper, and sealing one end of inner tube, sealingly inserted to said inner tube;

a coiled constant force spring small constant force springs, for providing retraction force upon piston;

a cylindrical plastic rod small spring drums, for providing rotating mount onto which small constant force spring is coiled, circumferentially wrapped to said small constant force springs;

a small spring drum axles, for providing pivot for small spring drum to rotate upon, rotatably encircling to said small spring drums, and axially fastened to said inner tube spring housing;

a large constant force springs end mount, for applying large constant force springs retraction force to innermost end of inner tube and also attaching inner tube seal to inner tube spring housing, securely fastened to said inner tube spring housing, and securely fastened to said large constant force springs;

a flexible plastic or rubber-like material inner tube seal, for providing an air-tight seal between inner tube and outer tube, sealingly retained to said inner tube spring housing;

a rubber-like cushioning bumper with attachment bolt on one end outer tube spring housing bumpers, for providing a cushion between outer tube constant force spring housing and large constant force springs end mount at innermost end of inner tube travel, securely fastened to said outer tube spring housing;

a rubber-like cushion with mounting bolt on one end inner tube spring housing bumper, for providing cushion between inner tube spring housing and small constant force springs end mount at innermost end of piston travel, securely fastened to said inner tube spring housing;

a plastic material, 020" smaller than inner dimension of inner tube, same shape as inside of inner tube piston, for providing a mount for pivot spring female mounting tube;

a plastic or rubber-like material piston seal, for providing air-tight seal between piston and inner tube, sealingly retained to said piston;

a small constant force springs end mount, for applying small constant force springs retraction force to piston and for holding piston seal to piston, securely screwed to said piston, and securely fastened to said small constant force springs;

a high-force type magnet, for operating magnetic switch when inner tube and piston are fully retracted, entirely inserted to said piston;

a pivot spring assembly female mounting tube, for providing female mount of pivot spring assembly (male) to piston, centrally inserted and fastened to said piston, removably inserted to said pivot spring release pin, and releasably coupled to said pivot spring assembly;

a piston end stops, for providing a stop for a piston at the outer end of travel in the extended position, securely fastened to said inner tube;

a reed-type switch magnetic switch, for sensing when piston and inner tube are at the innermost ends of both their travels and relaying this to dash mounted indicator light, magnetically linked to said magnet, directly attached to said outer tube, and electrically wired to said electrical control enclosure;

a pop off valve, for preventing excessive pressure inside telescoping assembly, threadably coupled to said outer tube;

a same material as outer tube outer tube anti slide brackets, for preventing the telescoping assembly from sliding in its mounting brackets; and a telescoping assembly, for facilitating the placement of a dissabling device.

* * * * *